US007051955B2

(12) United States Patent
Horner et al.

(10) Patent No.: US 7,051,955 B2
(45) Date of Patent: May 30, 2006

(54) SPRAYER SYSTEM

(76) Inventors: Joseph D. Horner, 5291 Enchanted Cove, Lilburn, GA (US) 30047; Kevin L. Clerk, 2830 Evergreen Eve Crossing, Dacula, GA (US) 30019

( * ) Notice: Subject to any disclaimer, the term of this patent is extended or adjusted under 35 U.S.C. 154(b) by 125 days.

(21) Appl. No.: 10/835,840

(22) Filed: Apr. 30, 2004

(65) Prior Publication Data

US 2005/0242208 A1 Nov. 3, 2005

(51) Int. Cl.
*B05B 7/12* (2006.01)

(52) U.S. Cl. ..... 239/417.3; 239/310; 239/315; 239/316; 239/311; 239/312; 239/407; 239/419; 239/419.5; 239/428.5; 239/432; 239/433; 239/391; 239/525; 239/530; 239/532; 239/450; 239/536; 239/590.3; 239/601; 239/DIG. 23

(58) Field of Classification Search ..... 239/310, 239/315, 316, 311, 312, 407, 419, 419.5, 239/428.5, 433, 432, 390, 391, 525, 530, 239/532, 450, 536, 590.5, 590, 601, 597, 239/598, 581.1, 565, 754; 169/15
See application file for complete search history.

(56) References Cited

U.S. PATENT DOCUMENTS 3,134,545 A * 5/1964 Armond ..... 239/312
3,961,754 A 6/1976 Kuhns et al.
3,980,238 A * 9/1976 Adiletta ..... 239/590.3
4,071,195 A 1/1978 Kuhns et al.
4,277,030 A 7/1981 Hechler, IV
4,925,106 A 5/1990 Maas et al.
5,160,093 A * 11/1992 Battaglia ..... 239/444
5,556,032 A * 9/1996 Varrichione ..... 239/279
5,678,765 A * 10/1997 Dobbs et al. ..... 239/333
5,975,434 A * 11/1999 Douglas ..... 239/553.3
6,347,752 B1 2/2002 Davidson et al.
6,378,789 B1 * 4/2002 Seaman et al. ..... 239/443
6,676,041 B1 * 1/2004 McLoughlin et al. ..... 239/565

* cited by examiner

*Primary Examiner*—David A. Scherbel
*Assistant Examiner*—Trevor McGraw

(57) ABSTRACT

A chemical sprayer system includes a three-way valve that includes an inlet port coupled to a fluid source, a first outlet port in fluid communication with a first elongated fluid passage, a second outlet port in fluid communication with a second elongated fluid passage, and a control. The control allows a user to place the three-way valve into one of a first ON state in which the first outlet port is in fluid communication with the inlet port, a second ON state in which the second outlet port is in fluid communication with the inlet port, and an OFF state in which substantially no fluid is allowed to exit the inlet port. The first elongated fluid passage terminates in a nozzle adapted for spraying foam. The second elongated fluid passage terminates in a nozzle adapted for spraying liquids.

12 Claims, 2 Drawing Sheets

SPRAYER SYSTEM

BACKGROUND OF THE INVENTION

1. Field of the Invention

The present invention relates to sprayers and, more specifically, to a system for spraying chemicals.

2. Description of the Prior Art

Floor cleaning and sanitation is critical in such industries as food service and production. One method of floor cleaning and sanitation includes cleaning the floor with a mop and a bucket filled with a detergent/water mixture. The floor is then rinsed with water, which is subsequently mopped up and disposed in the bucket. A sanitizer/water mixture is then applied with the mop to kill remaining microbes. This method is time consuming, strenuous for large floor surfaces and introduces the possibility of cross-contamination between the steps involved when the same mop is used for each step.

Typical operations, such as supermarket meat cutting facilities, employ central chemical proportioning systems to provide cleaning chemicals to users. Such systems include a detergent input, a sanitizer input, a water-only bypass and an output that is connectable to a hose. A plurality of valves allows a user to select between various combinations being delivered to the hose for subsequent spraying on the floor, these include: detergent/water (for cleaning), water only (for rinsing) and sanitizer/water (for sanitizing).

Typically, the user initially applies water only spray through a spray nozzle to remove gross soils, then the user applies the water/detergent combination through a foaming wand coupled to the hose. The user then turns off the detergent/water feed from the proportioning system, scrubs the floor with a stiff-bristle broom and then resets the proportioning system for rinsing with water. At this point, the user has to replace the foaming wand with a spray nozzle, similar to a typical garden spray nozzle. The user then rinses with water, driving the foam into a floor drain. Next the user resets the proportioning system to receive the sanitizer/water combination and applies the sanitizer to the floor either through a spray nozzle or through a foaming wand.

Existing systems have the disadvantage of requiring the user to bend over to hold the foaming wand and the spray nozzle close to the floor. This can cause discomfort and the possibility of back strain. Also, the spray nozzle and foaming wand both have a circular spray pattern, which gives rise to the possibility of cross contamination of items (such as food and equipment) placed above floor level. Furthermore, existing systems also require the user to change between a foaming wand and a spray nozzle, which is inconvenient and time consuming.

Therefore, there is a need for spray system that allows the user to apply chemicals to a floor that reduces bending over by the user. There is also a need for spray system that can change from a foaming mode to a spray mode without requiring the user to change or switch a nozzle for a foaming wand. There is also a need for spray system that concentrates the spray close to the floor. There is also a need for spray system that has a substantially flat spray pattern, rather than a circular pattern.

SUMMARY OF THE INVENTION

The disadvantages of the prior art are overcome by the present invention which, in one aspect, is a chemical sprayer system that includes a three-way valve, a first elongated fluid passage and a second elongated fluid passage. The three-way valve includes an inlet port, that is capable of being coupled to a fluid source, a first outlet port, a second outlet port, and a three-state control that allows a user to place the three-way valve into one of a plurality of states. The plurality of states includes: a first ON state in which the first outlet port is in fluid communication with the inlet port, a second ON state in which the second outlet port is in fluid communication with the inlet port, and an OFF state in which substantially no fluid is allowed to exit the inlet port to either the first outlet port or the second outlet port. The first elongated fluid passage has a first proximal end and an opposite first distal end. The first proximal end is in fluid communication with the first outlet port. The first distal end terminates in a first nozzle, which is adapted for spraying foam. The second elongated fluid passage is spaced apart from and is substantially parallel to the first elongated fluid passage. The second elongated fluid passage has a second proximal end and an opposite second distal end. The second proximal end is in fluid communication with the second outlet port. The second distal end terminates in a second nozzle, which is adapted for spraying liquid phase fluids.

In another aspect, the first elongated fluid passage includes a first parallel portion, spaced apart from the second elongated fluid passage at a first distance, a second parallel portion, spaced apart from the second elongated fluid passage at a second distance that is less than the first distance and a transverse portion connecting the first parallel portion to the second parallel portion. A disk that defines a plurality of holes passing therethrough is disposed transversely to the transverse portion. An air intake is defined by the transverse portion and is disposed downstream from the disk.

In yet another aspect, the invention is a method of making a chemical sprayer. A first elongated passage is adapted for generating foam and is placed in fluid communication with a first outlet port of a three-way valve. A second elongated passage, adapted for spraying a liquid, is placed in fluid communication with a second outlet port of a three-way valve so that the second elongated passage is substantially parallel to the first elongated passage.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
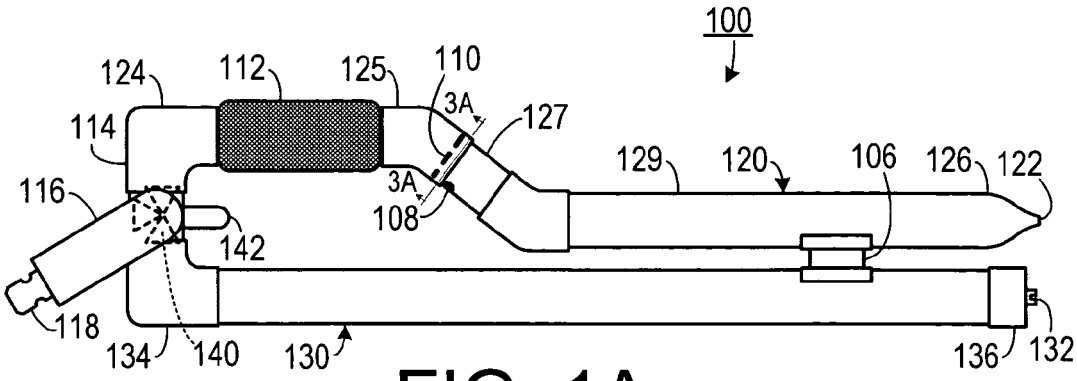
FIG. 1A is a side elevational view of one embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1B:
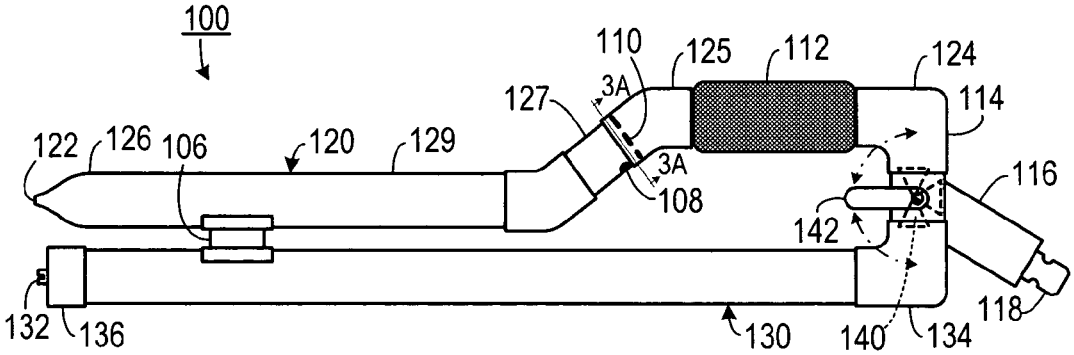
FIG. 1B is a side elevational view of the embodiment of the invention shown in FIG. 1A, showing the opposite side from that shown in FIG. 1A.
Figure 2:
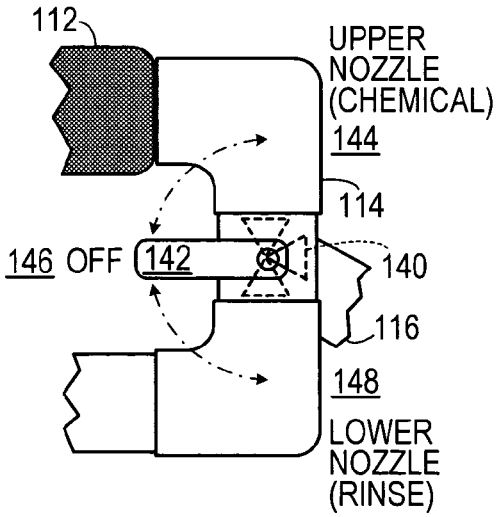
FIG. 2 is a detail of the valve portion of the embodiment shown in FIG. 1B.

As shown in FIGS. 1A, 1B and 2, one embodiment of the invention is a sprayer system 100 that includes a three-way valve 140 having an inlet port, a first outlet port, a second outlet port. The three-way valve 140 is coupled to a three-state control 142 that allows the user to place the three-way valve into one of three states: a first ON state 144, a second ON state 148 and an OFF state 146. In the first ON state 144, the first outlet port is in fluid communication with the inlet port. In the second ON state 148, the second outlet port is in fluid communication with the inlet port. In the OFF state 146, substantially no fluid is allowed to exit the inlet port to either the first outlet port or the second outlet port. The inlet port of the three-way valve 140 is coupled to a fluid source 116, which may include a quick-connect 118 that allows quick coupling and de-coupling of the sprayer system 100 to a hose.

A first elongated fluid passage 120 has a first proximal end 124 and an opposite first distal end 126. The first proximal end 124 is in fluid communication with the first outlet port of the three-way valve 140 and the first distal end 126 terminates in a first nozzle 122. The first nozzle 122 is adapted for spraying foam. A second elongated fluid passage 130 is spaced apart from and substantially parallel to the first elongated fluid passage 120. The second elongated fluid passage 130 has a second proximal end 134 and an opposite second distal end 136. The second proximal end 134 is in fluid communication with the second outlet port of the three-way valve 140 and the second distal end 136 terminates in a second nozzle 132. The second nozzle is adapted for spraying liquid-phase fluids, such as water. A connecting passage 114 couples the first proximal end 124 of the first elongated passage 120 to the second proximal end 134 of the second passage 130 and houses the three-way valve 140. A spacer member 106 couples the first elongated fluid passage 120 to the second elongated fluid passage 130, thereby providing rigidity. In one embodiment, the first elongated fluid passage 120, second elongated fluid passage 130 and the connecting passage 114 are all made from polyvinyl-chloride (PVC) pipe. However, it is understood that many other materials may be used. For example, all of the passages may include injection molded plastic or may be fabricated from metal.

The first elongated fluid passage 120 includes a first parallel portion 125, a second parallel portion 129 and a transverse portion 127. The first parallel portion 125 is spaced apart from the second elongated fluid passage 130 at a first distance. The second parallel portion 129 is spaced apart from the second elongated fluid passage 130 at a second distance that is less than the first distance. The transverse portion 127 connects the first parallel portion 125 to the second parallel portion 129. A handle portion 112 (such as a high density foam sheet or molded foam) may be disposed about at least part of the first parallel portion 125 to facilitate gripping and to provide thermal insulation.

Figure 3A:
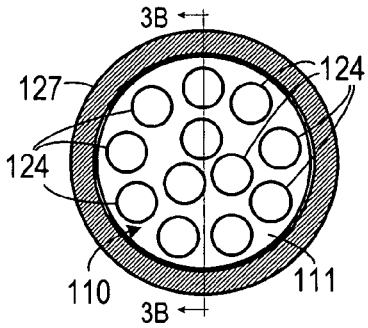
FIG. 3A is a cross sectional view of the first elongated fluid passage taken along line 3A—3A in FIG. 1.
Figure 3B:
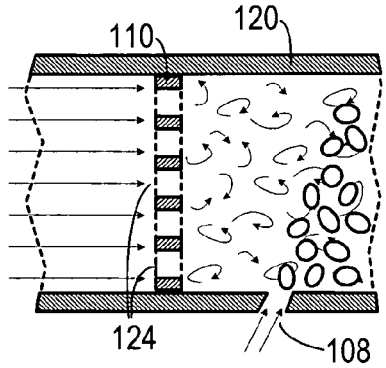
FIG. 3B is a cross sectional view of the first elongated fluid passage taken along line 3B—3B in FIG. 3A.

A turbulence causing member 110 is disposed in the transverse portion 127 and an air intake 108 (such as a hole) defined by the transverse portion 127 is disposed downstream from the turbulence causing member 110. As shown in FIG. 3A, the turbulence causing member 110 may include a disk 111 disposed transversely to the transverse portion 127. The disk defines a plurality of holes 124 that pass therethrough. As shown in FIG. 3B, as a liquid 121 flows through the holes 124, the liquid 121 becomes turbulent. Air is drawn in through the air intake 108 and mixes with the liquid 121. If the liquid 121 includes a surfactant, then foam will be formed as air bubbles 123 are suspended in the liquid 121.

Figure 4A:
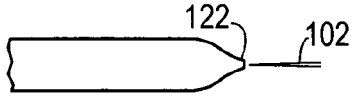
FIG. 4A is a side view of the nozzle portion of the first elongated fluid passage.
Figure 4B:
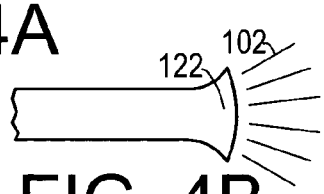
FIG. 4B is a top view of the nozzle portion of the first elongated fluid passage.
Figure 5A:
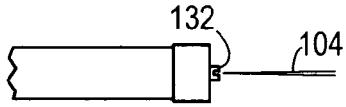
FIG. 5A is a side view of the nozzle portion of the second elongated fluid passage.
Figure 5B:
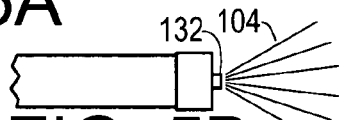
FIG. 5B is a top view of the nozzle portion of the second elongated fluid passage.

As shown in FIGS. 4A and 4B, the first nozzle 122 has a fan shape so that spray 102 from the nozzle is constrained in a non-circular spray pattern. Similarly, the second nozzle 132 has a slotted shape so as to constrain spray 104 issuing therefrom to a non-circular pattern.

Figure 6:
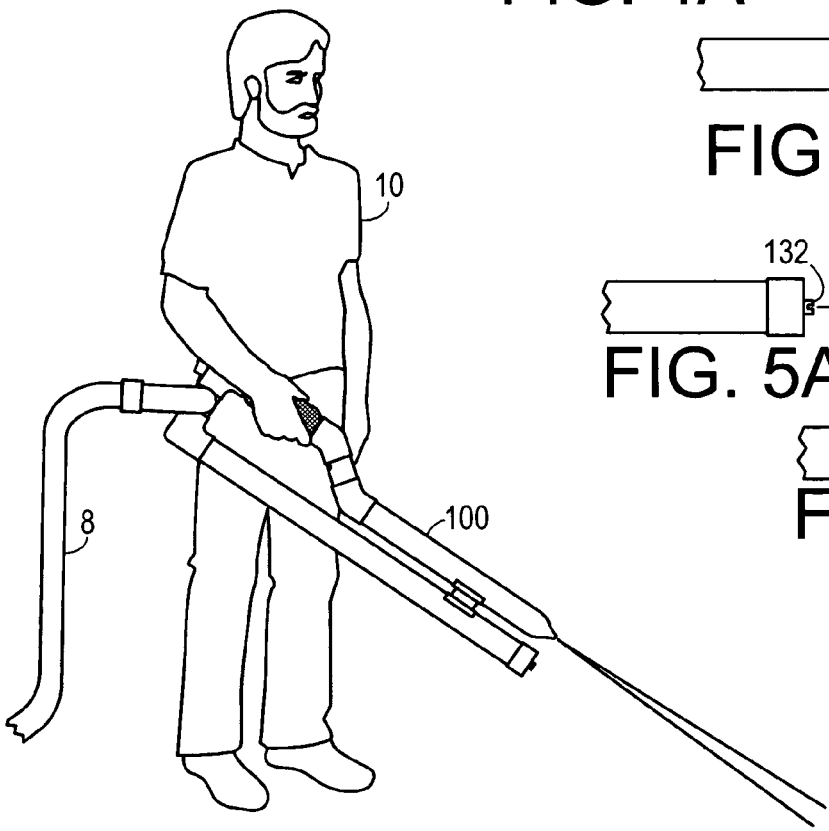
FIG. 6 is a perspective view of a person using one embodiment of the invention.

Use of the sprayer system 100 by a user 10 is shown in FIG. 6. The user 10 is able to hold the sprayer by the handle 112, with the nozzles 122 and 132 being close to the floor. The non-circular spray pattern from the nozzles 122 and 132 allows the user 10 to spray a floor without a substantial amount of liquid or foam contaminating objects that are placed above the floor. Typically, the sprayer system 100 is connected to a hose 8 that receives liquid from a chemical proportioning system (not shown) that is capable of mixing such chemicals as a detergent, a sanitizer and water. With such a configuration, the user 10 could initially spray a floor with a detergent by setting the proportioning system to a detergent and water mode and then setting the three-state control 142 to the first ON state 144, thereby causing the resulting foam mixture to pass through the first passage 120 and spray out of the first nozzle 122. To rinse, the user then sets the three-state control 142 to the OFF state 146 and changes the configuration of the proportioning system to allow only water to pass through the hose 8. The user 10 then sets the three-state control 142 to the second ON state 148, thereby causing the water to pass through the second passage 130 and spray out of the second nozzle 132. This step may be repeated to spray a non-foaming sanitizer.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A chemical sprayer system, comprising:

a. a three-way valve including an inlet port, that is capable of being coupled to a fluid source, a first outlet port, a second outlet port, and a three-state control that allows a user to place the three-way valve into one of a plurality of states, including: a first ON state in which the first outlet port is in fluid communication with the inlet port, a second ON state in which the second outlet port is in fluid communication with the inlet port, and an OFF state in which substantially no fluid is allowed to exit the inlet port to either the first outlet port or the second outlet port;

b. a first elongated fluid passage having a first proximal end and an opposite first distal end, the first proximal end in fluid communication with the first outlet port, the first distal end terminating in a first nozzle, the first nozzle adapted for spraying foam;

c. a second elongated fluid passage, spaced apart from and substantially parallel to the first elongated fluid passage, having a second proximal end and an opposite second distal end, the second proximal end in fluid communication with the second outlet port, the second distal end terminating in a second nozzle, the second nozzle adapted for spraying liquid phase fluids:

d. a first parallel portion, spaced apart from the second elongated fluid passage at a first distance;

e. a second parallel portion, spaced apart from the second elongated fluid passage at a second distance, the second distance being less than the first distance; and f. a transverse portion connecting the first parallel portion to the second parallel portion.

2. The chemical sprayer of claim 1, further comprising a connecting passage that couples the first proximal end of the first elongated passage to the second proximal end of the second passage and that houses the three-way valve.

3. The chemical sprayer of claim 1, further comprising a spacer member that couples the first elongated fluid passage to the second elongated fluid passage.

4. The chemical sprayer of claim 1, wherein the first nozzle has a fan shape so that spray from the first nozzle is constrained in a non-circular spray pattern.

5. The chemical sprayer of claim 1, wherein the second nozzle has a slotted shape so that spray from the second nozzle is constrained in a non-circular spray pattern.

6. The chemical sprayer of claim 1, further comprising:

a. a turbulence causing member disposed in the transverse portion; and b. an air intake defined by the transverse portion and disposed downstream from the turbulence causing member.

7. The chemical sprayer of claim 6, wherein the turbulence causing member comprises a disk disposed transversely to the transverse portion, the disk defining a plurality of holes passing therethrough.

8. A chemical sprayer system, comprising:

a. a three-way valve including an inlet port, that is capable of being coupled to a fluid source, a first outlet port, a second outlet port, and a three-state control that allows a user to place the three-way valve into one of a plurality of states, including: a first ON state in which the first outlet port is in fluid communication with the inlet port, a second ON state in which the second outlet port is in fluid communication with the inlet port, and an OFF state in which substantially no fluid is allowed to exit the inlet port to either the first outlet port or the second outlet port;

b. a first elongated fluid passage having a first proximal end and an opposite first distal end, the first proximal end in fluid communication with the first outlet port, the first distal end terminating in a first nozzle, the first nozzle adapted for spraying foam, the first elongated fluid passage including:

i. a first parallel portion, spaced apart from the second elongated fluid passage at a first distance;

ii. a second parallel portion, spaced apart from the second elongated fluid passage at a second distance, the second distance being less than the first distance;

iii. a transverse portion connecting the first parallel portion to the second parallel portion;

iv. a disk disposed transversely to the transverse portion, the disk defining a plurality of holes passing therethrough; and v. an air intake defined by the transverse portion and disposed downstream from the disk;

c. a second elongated fluid passage, spaced apart from and substantially parallel to the first elongated fluid passage, having a second proximal end and an opposite second distal end, the second proximal end in fluid communication with the second outlet port, the second distal end terminating in a second nozzle, the second nozzle adapted for spraying liquid phase fluids; and d. a connecting passage that couples the first proximal end of the first elongated passage to the second proximal end of the second passage and that houses the three-way valve.

9. The chemical sprayer of claim 8, further comprising a spacer member that couples the first elongated fluid passage to the second elongated fluid passage.

10. The chemical sprayer of claim 8, wherein the first nozzle has a fan shape so that spray from the first nozzle is constrained in a non-circular spray pattern.

11. The chemical sprayer of claim 8, wherein the second nozzle has a slotted shape so that spray from the second nozzle is constrained in a non-circular spray pattern.

12. The chemical sprayer of claim 8, wherein the first elongated passage, the second elongated passage and the connecting passage each comprise PVC pipe.

* * * * *